US010428653B2

(12) United States Patent
Parianos et al.

(10) Patent No.: US 10,428,653 B2
(45) Date of Patent: Oct. 1, 2019

(54) DECOUPLED SEAFLOOR MINING SYSTEM

(71) Applicant: Nautilus Minerals Singapore Pte Ltd, Singapore (SG)

(72) Inventors: John Michael Parianos, Milton (AU); Roland Gunter Berndt, Milton (AU); Sean Michael Plunkett, Milton (AU)

(73) Assignee: Nautilius Minerals Singapore Pte Ltd, Singapore (SG)

( * ) Notice: Subject to any disclaimer, the term of this patent is extended or adjusted under 35 U.S.C. 154(b) by 90 days.

(21) Appl. No.: 15/312,180

(22) PCT Filed: May 19, 2015

(86) PCT No.: PCT/SG2015/000129
§ 371 (c)(1),
(2) Date: Nov. 17, 2016

(87) PCT Pub. No.: WO2015/178854
PCT Pub. Date: Nov. 26, 2015

(65) Prior Publication Data

US 2017/0122102 A1 May 4, 2017

(30) Foreign Application Priority Data

May 19, 2014 (AU) ..... 2014901856

(51) Int. Cl.
*E21C 50/00* (2006.01)
*E02F 7/00* (2006.01)
(Continued)

(52) U.S. Cl.
CPC ..... *E21C 50/00* (2013.01); *B63C 11/52* (2013.01); *B63G 8/42* (2013.01); *E02F 3/8875* (2013.01);
(Continued)

(58) Field of Classification Search
CPC ..... E21C 50/00; B63G 8/42; E02F 3/8875; E02F 7/005
See application file for complete search history.

(56) References Cited

U.S. PATENT DOCUMENTS 3,314,174 A 4/1967 Haggard
3,672,725 A 6/1972 Johnson
(Continued)

FOREIGN PATENT DOCUMENTS

CA 2881719 A1 2/2014
DE 2444987 A1 4/1975
(Continued)

OTHER PUBLICATIONS

Chung, Jin S., "Deep-ocean Mining Technology: Development II", Proceedings of the Sixth Mining Symposium Changsha, Hunan, China Oct. 9-13, 2005, The International Society of Offshore and Polar Engineers.

(Continued)

*Primary Examiner* — Tara Mayo-Pinnock
(74) *Attorney, Agent, or Firm* — McDonnell Boehnen Hulbert & Berghoff LLP

(57) ABSTRACT

A multi-stage seafloor mining system that has at least concentration stage, a reclamation stage, and a haulage stage. The system includes a concentrating system (50) that processes seafloor materials, a reclaimer machine (300) that collects the processed seafloor materials, and a mechanical haulage system (40) that receives the processed seafloor materials collected by the reclaimer machine (300) and conveys discrete parcels of the processed seafloor materials to a surface vessel (100).

7 Claims, 3 Drawing Sheets

(51) Int. Cl.

| | |
|---|---|
| ***E02F 5/00*** | (2006.01) |
| ***B63C 11/52*** | (2006.01) |
| ***E02F 3/88*** | (2006.01) |
| ***B63G 8/42*** | (2006.01) |
| *B63B 21/66* | (2006.01) |

(52) U.S. Cl.
CPC ..... *E02F 7/005* (2013.01); *B63B 21/66* (2013.01); *E02F 3/8866* (2013.01)

(56) References Cited

U.S. PATENT DOCUMENTS

| | | | | |
|---|---|---|---|---|
| 3,837,707 | A * | 9/1974 | Kilroy | E21C 25/60 299/18 |
| 3,971,593 | A | 7/1976 | Porte et al. | |
| 3,973,575 | A | 8/1976 | Sullivan et al. | |
| 3,999,313 | A | 12/1976 | Andrews | |
| 4,010,560 | A | 3/1977 | Diggs | |
| 4,042,279 | A | 8/1977 | Asakawa | |
| 4,052,800 | A | 10/1977 | Fuhrboter | |
| 4,155,491 | A | 5/1979 | Istoshin et al. | |
| 4,232,903 | A | 11/1980 | Welling et al. | |
| 4,503,629 | A * | 3/1985 | Uchida | E02F 3/88 198/812 |
| 4,685,742 | A | 8/1987 | Moreau | |
| 2009/0284068 | A1 * | 11/2009 | Yu | E02F 3/8858 299/1.9 |

FOREIGN PATENT DOCUMENTS

| | | | |
|---|---|---|---|
| DE | 197 15 284 | A1 | 10/1998 |
| EP | 0 677 753 | A1 | 10/1995 |
| JP | 2012-144943 | A | 8/2012 |
| RU | 2001276 | C1 | 10/1993 |
| WO | 11/156867 | A1 | 12/2011 |
| WO | 2012023676 | A1 | 2/2012 |
| WO | 14/168581 | A1 | 10/2014 |

OTHER PUBLICATIONS

Extended European Search Report for PCT/SG2015000129 dated May 14, 2018.

* cited by examiner

DECOUPLED SEAFLOOR MINING SYSTEM

This application is a US national phase of International Application No. PCT/SG2015/000129 filed on May 19, 2015, which claims priority to Australian Patent Application No. 2014901856 filed on May 19, 2014, which are hereby incorporated by reference in their entirety.

FIELD OF THE INVENTION

The invention relates to a seafloor mining system decoupled into multiple stages. In particular, the invention relates, but is not limited, to a decoupled seafloor mining system comprising a concentration stage, a reclamation stage, and a haulage stage.

BACKGROUND TO THE INVENTION

Reference to background art herein is not to be construed as an admission that such art constitutes common general knowledge.

In various locations in the ocean valuable seafloor materials, such as sulphide precipitates or polymetallic nodules, exist in a surface layer on the seafloor at water depths of between around 300 to 6,000 meters, often around 4,000 to 5,000 meters.

There have been various attempts to develop commercially viable mining systems that collect and then convey the nodules from the seafloor. Typically such systems are complex as several different actions need to be accounted for. For example, there can be seafloor mining machines which mine the seafloor, seafloor reclaimer machines which gather the seafloor material, and seafloor haulage systems, such as a riser, which hauls the gathered seafloor material to the surface. If these machines are integrated into a single mining system these all must operate simultaneously and co-operatively to obtain maximum output efficiency of the system.

However, as soon as one machine encounters a problem the entire production system halts or, at least, has reduced throughput. Furthermore, the large amount of infrastructure on or near the seafloor can create traffic problems with different machines or equipment getting in the way of other machines or equipment. Not only can this result in reduced productivity, but there can be collisions or entanglement of lines (e.g. umbilical lines) which can damage or reduce productivity of the machines or equipment.

A particularly costly part of the process relates to the surface vessel and associated haulage system. The surface vessel needs to be large enough to have a riser system extending towards the seafloor of a length sufficient to deliver the ore to the surface vessel. The weight associated with a riser system of this scope is significant and thus the surface vessel needs to be of a size to be able to carry that weight. Additionally, a significant amount of energy is expended in hauling the nodules to the surface. This leads to very high operating costs in reclaiming gathered seafloor materials, particularly when relatively small amount of nodules may be gathered in any given time period, or where water depths are great and the hauling vertical distance is large.

OBJECT OF THE INVENTION

It is an aim of this invention to provide a seafloor mining system which overcomes or ameliorates one or more of the disadvantages or problems described above, or which at least provides a useful alternative.

Other preferred objects of the present invention will become apparent from the following description.

SUMMARY OF INVENTION

In one form, although it need not be the only or indeed the broadest form, there is provided a seafloor mining system comprising:

at least one concentrating system that processes seafloor materials;

at least one reclaimer machine that collects the processed seafloor materials; and at least one haulage system that receives the processed seafloor materials collected by the reclaimer machine and lifts the processed seafloor materials to a surface vessel;

wherein the haulage system is a mechanical haulage system that conveys discrete parcels of seafloor material collected by the reclaimer machine to the surface vessel.

Preferably the at least one concentrating system is adapted to arrange processed seafloor materials on the seafloor and the at least one reclaimer machine is adapted to collect the processed seafloor materials from the arranged processed seafloor materials on the seafloor. Preferably the at least one concentrating system is adapted to arrange the processed seafloor materials in windrows on the seafloor. Preferably the at least one reclaimer machine is adapted to collect the processed seafloor from the windrows on the seafloor.

Preferably the at least one concentrating system comprises an undersea vehicle. Preferably the undersea vehicle is towed by a tow vessel, preferably located on the surface. Preferably the undersea vehicle comprises a nodule collecting apparatus located on the seafloor. Preferably the nodule collecting apparatus is connected to a steering vehicle. Preferably the steering vehicle is adapted to be towed by the tow vessel.

Preferably the undersea vehicle comprises a position determination device adapted to determine the position of the nodule collecting apparatus. Preferably the position determination device communicates position information of the nodule collecting apparatus to the steering vehicle and/or tow vessel.

Preferably, the steering vehicle is adapted to alter the direction of the nodule mining apparatus. Suitably, the steering vehicle is adapted to alter the direction of the nodule collecting apparatus in response to receiving position information of the nodule collecting apparatus from the position determination device.

Preferably the nodule collecting apparatus comprises a plurality of nodule collection devices. Preferably the nodule collection devices are secured to a support member. Preferably each nodule collection device is adapted to collect ore nodules from the seafloor adjacent an underside thereof and communicate those nodules to an outlet pipe. Preferably the nodule collecting apparatus comprises a combined outlet pipe adapted to receive collected ore nodules from the outlet pipe of each nodule collection device and re-deposit the collected nodules on the seafloor in the form of a windrow.

Preferably the haulage system comprises one or more containers. Preferably the containers receive the processed seafloor materials from the reclaimer machine and carry the processed seafloor materials towards the surface. Preferably the haulage system comprises at least one line member that extends at least partially between the seafloor and the surface. Preferably a container is connected to the line member. Preferably the containers are towed by the line member. Preferably the line member is driven by a winch. Preferably at least a substantial portion of the line member is synthetic rope.

Preferably each container has a steerable element that enables the container to manoeuvre as it is propelled, preferably towed, in the water. Preferably the steerable element comprises at least one adjustable surface. The steerable element may comprise a rudder, flap, thruster, and/or at least one adjustable hydrofoil. Preferably the steerable element is controlled to guide the container along a path. The steerable element may be controlled remotely but is preferably controlled autonomously. Preferably the steerable element is controlled by actively trimming the steerable element.

Preferably the container further comprises a position determination system, even more preferably an inertial navigation system that provides a position estimate based on inertial measurements. Preferably the steerable element is controlled with respect to the position estimate from the position determination system. Preferably the container is programmed to follow a predetermined path.

Preferably the at least one reclaimer machine comprises a seafloor vehicle that drives on the seafloor over the processed seafloor material. Preferable the reclaimer machine is adapted to collect a windrow of processed seafloor material on the seafloor without collecting a significant proportion of unprocessed seafloor material from the seafloor. Preferably the at least one reclaimer machine comprises a pump to hydraulically pump the processed seafloor material in slurry form, to a temporary storage container. Preferably the temporary storage container is a buffer suspended above the seafloor. Preferably the buffer receives the processed seafloor material from the reclaimer machine via a slurry hose. Preferably the buffer further processes the gathered seafloor material.

Preferably the temporary storage container is configured to transfer the gathered seafloor material to a container of the haulage system. Preferably the container of the haulage system travels to the temporary storage container and is loaded with a discrete parcel of seafloor material from the temporary storage container. Preferably the container then carries that discrete parcel of seafloor material from the temporary storage container towards the surface.

Preferably a plurality of containers convey gathered seafloor material from at least one temporary storage container to a single surface vessel. Preferably a plurality of reclaimer machines collect processed seafloor material from the seafloor to the at least one temporary storage container.

In another form, the invention resides in a method of mining the seafloor, the method comprising the steps of:

concentrating desirable seafloor materials by processing seafloor materials with a concentrating system;

collecting the processed seafloor materials with a reclaimer machine;

conveying collected seafloor materials to a surface vessel using a mechanical haulage system that conveys discrete parcels of seafloor material from the reclaimer machine to the surface vessel.

Preferably the step of concentrating desirable seafloor materials comprises towing a nodule collecting apparatus behind a tow vessel, preferably located on the surface, along the seafloor. Preferably the step of concentrating desirable seafloor materials comprises determining when the nodule collecting apparatus deviates from a predetermined path. Preferably if the nodule collecting apparatus is determined to deviate from a predetermined path the direction of the nodule collecting apparatus is altered to return the nodule collecting apparatus to the predetermined path. Preferably, an undersea steering vehicle is disposed between the tow vessel and the nodule collecting apparatus and is adapted to alter the direction of the nodule mining apparatus.

Preferably the step of conveying collected seafloor materials to a surface vessel comprises transferring collected seafloor material to at least one container located at or near the seafloor. Preferably the method further comprises towing the container to the surface by at least one line member. Preferably towing the container to the surface comprises guiding the container using at least one steerable element of the container.

Preferably the step of collecting the seafloor material comprises transferring the collected seafloor materials from the reclaimer machine to a temporary storage container via a pipe, preferably in slurry form. Preferably the step of transferring collected seafloor material to at least one container located at or near the seafloor comprises transferring collected seafloor material from the temporary storage container to the container.

Further features and advantages of the present invention will become apparent from the following detailed description.

BRIEF DESCRIPTION OF THE DRAWINGS

By way of example only, preferred embodiments of the invention will be described more fully hereinafter with reference to the accompanying figures, wherein.

DETAILED DESCRIPTION OF THE DRAWINGS

Figure 1:
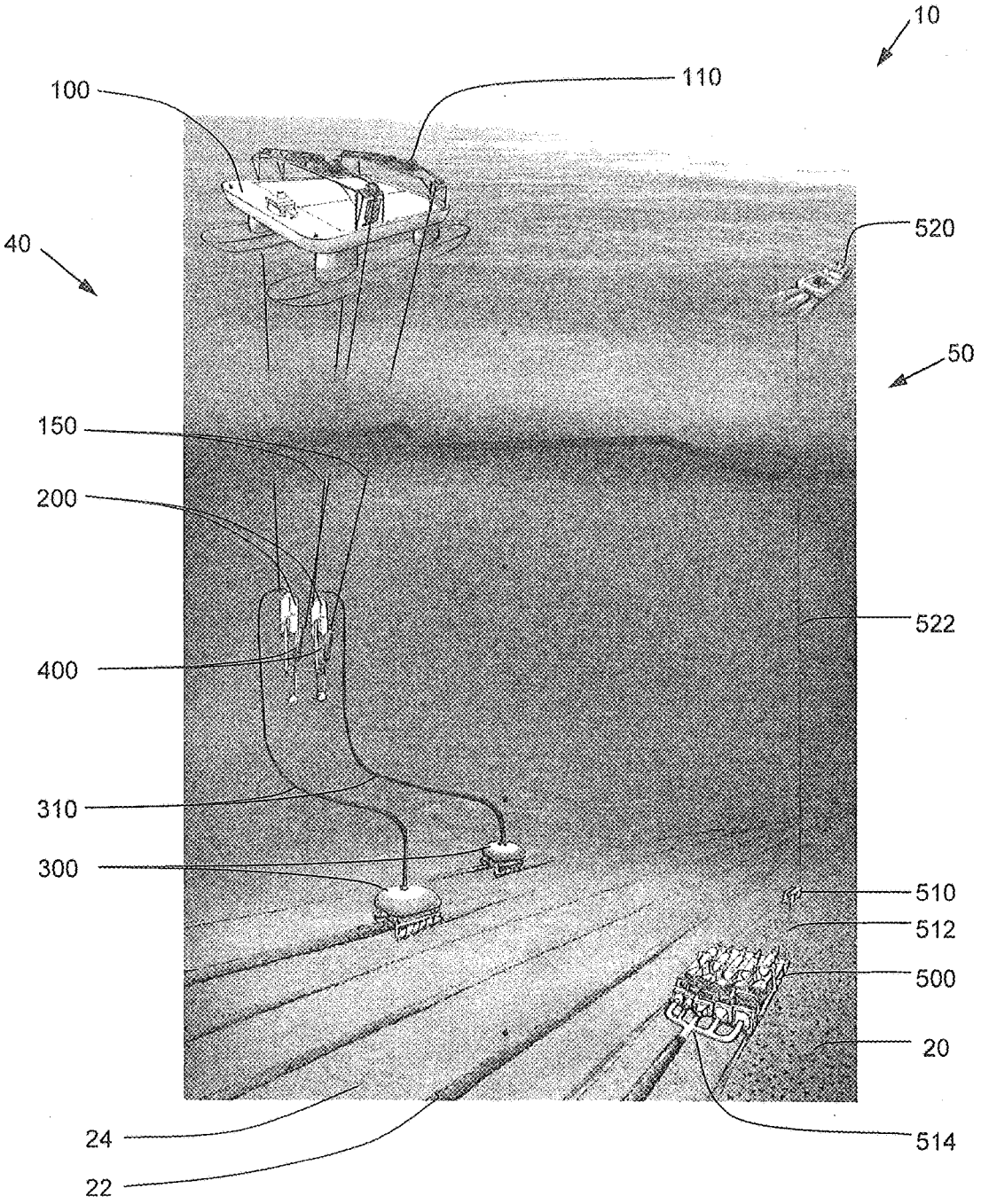
FIG. 1 is a perspective view of a seafloor mining system.
Figure 2:
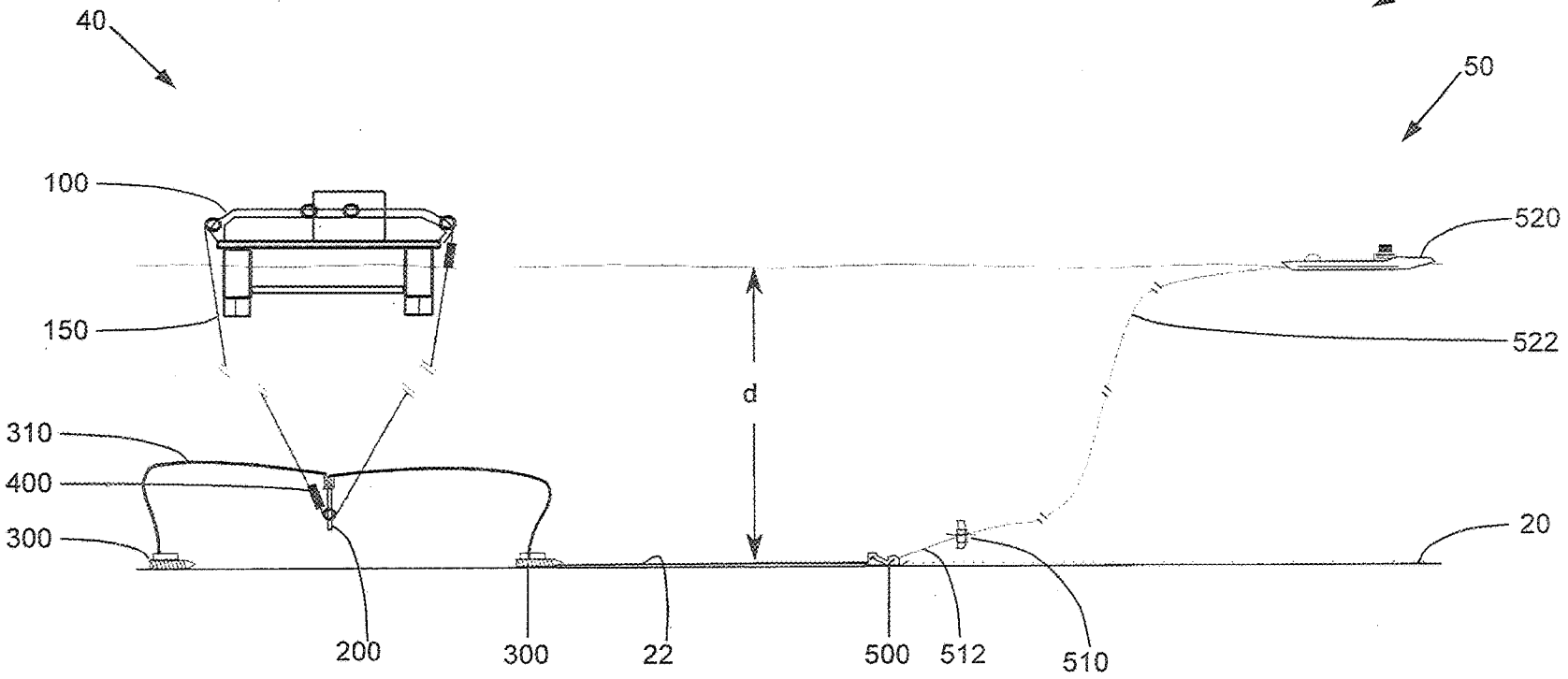
FIG. 2 is a side elevation view of a seafloor mining system.
Figure 3:
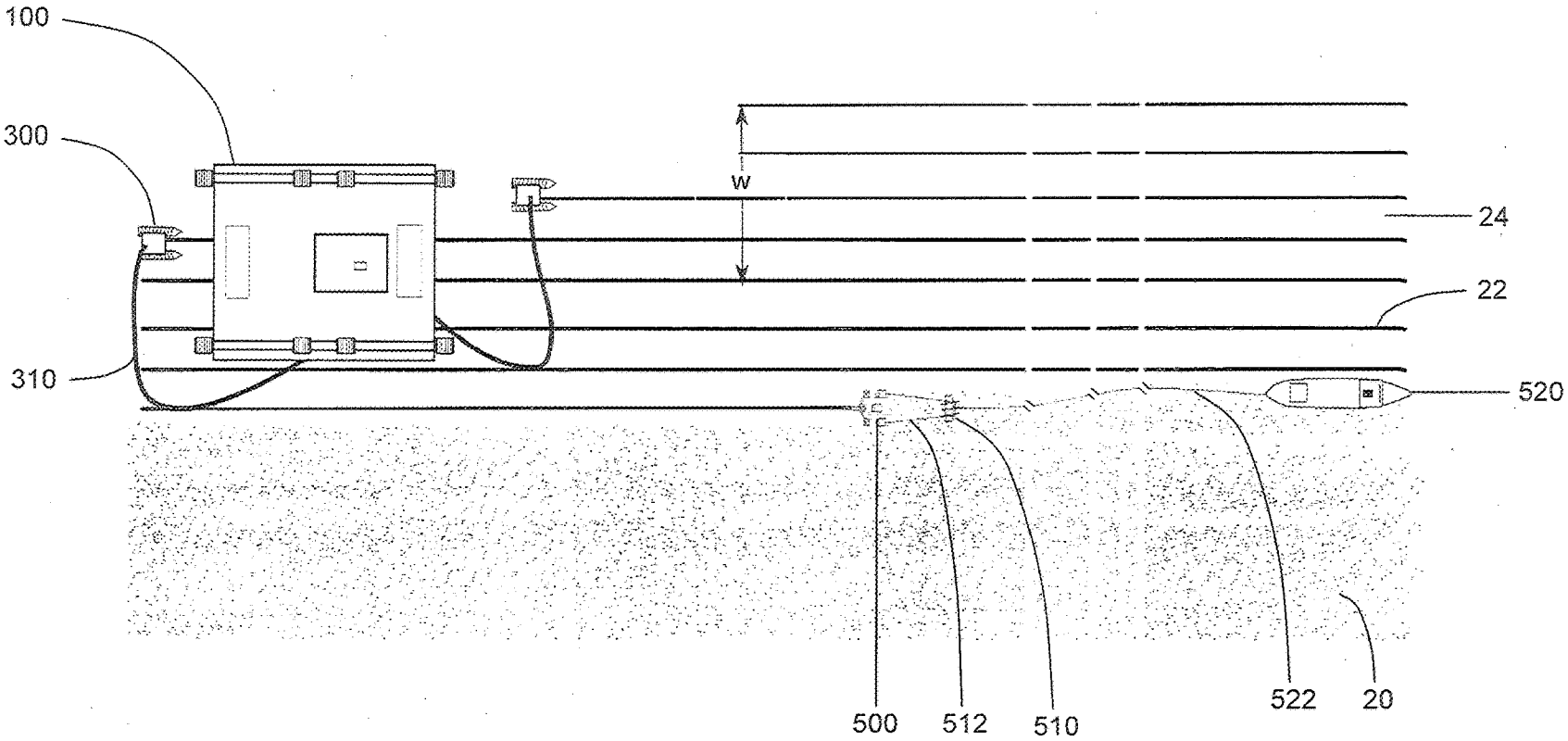
FIG. 3 is a plan view of a seafloor mining system.

FIGS. 1 to 3 illustrate a seafloor mining system 10 comprising a concentrating system 50 including an undersea vehicle having a nodule collecting apparatus 500 connected to a steering vehicle 510 which is towed by a tow vessel 520. To achieve desired throughput requirements of the seafloor mining system 10, there may be one or more concentrating systems 50. The seafloor mining system 10 also comprises one or more reclaimer machines 300 and a mechanical haulage system 40 that comprises containers 400 connected to line members 150 that extend between temporary storage containers, in the form of buffers 200, and a surface vessel 100.

The steering vehicle 510 of the concentrating system 50 is secured to the tow vessel 520 via tow line 522 and nodule collecting apparatus 500 is secured to the steering vessel 510 by way of vehicle lines 512. Tow vessel 520 is in the form of a boat, tug, or ship. Steering vehicle 510 is preferably in the form of a Remotely Operated Towed Vehicle (ROTV) that is adapted to be operated remotely and/or be programmed to follow a predetermined course.

Steering vehicle 510 is located proximal nodule collecting apparatus 500 and distal tow vessel 520. By way of example, in circumstances where nodule collecting apparatus 500 is operating in waters of depth 'd' (see FIG. 2) around 5,000 meters, the distance between the tow vessel 520 and the nodule collecting apparatus 500 may be 8,000 meters. On that distance, the steering vehicle 510 is preferably positioned about 20 to 100 meters from the nodule collecting apparatus 500.

The mechanical haulage system 40 receives collected seafloor material from reclaimer machines 300 via a pipes in the form of slurry hoses 310 connected to an inlet of the buffers 200. The buffers 200 store a quantity of collected seafloor material and when a container 400 is located nearby (as shown in FIG. 1) a discrete parcel of seafloor material is transferred into the container 400. Once the container 400 is loaded, a respective line member 150 tows the container 400 to the surface where it is unloaded to the surface vessel 100. The line member 150 is a synthetic rope driven by winches 110 located on the surface vessel 100. The containers 400 have a steerable element, preferably adjustable flaps, which enable the container 400 to manoeuvre in the water as it is towed by the line member 150 to prevent entanglement of underwater lines and/or collision of adjacent containers 400. To increase the haulage capacity of the overall seafloor mining system 10, more than one mechanical haulage system 40 can be ganged to provide a multiple haulage system 40, as illustrated in FIG. 1.

In use, the at least one concentrating system 50 processes seafloor 20 by towing nodule collecting apparatus 500, which has a plurality of nodule collection devices secured to a support member, behind tow vehicle 520. The nodule collecting apparatus 500 is directed by steering vehicle 510, which controls the path of the nodule collecting apparatus 500 using positional data from a position determination device to follow a predetermined path.

As the nodule collecting apparatus 500 traverses the seafloor 20 each nodule collection device of the nodule collecting apparatus collects nodules from the seafloor adjacent an underside thereof and communicates those nodules to a combined outlet pipe 514. The nodules of the seafloor material processed by the nodule collecting apparatus 500 is arranged as a concentrated windrow 22. As the nodule collecting apparatus 500 traverses the seafloor 20 it navigates using the position determination device and creates a plurality of elongate windrows 22 which are then, at a later time, picked up by reclaimer machines 300.

Depending on the system throughput requirements, one or more reclaimer machines 300 traverse the processed seafloor 24 collecting processed seafloor materials from the windrows 22. The reclaimer machines 300 are preferably either tracked or Archimedes screw propelled vehicles which are able to traverse the soft and often cohesive muds of the seafloor, using their own power and are not towed by any other form of vessel. The reclaimer machines 300 can be steered in a nimble manner so that the reclaimer machine 300 is able to negotiate the terrain and reliably collect the seafloor materials that have been deposited in a windrow 22. The reclaimer machines 300 are each powered and controlled by an umbilical 310 which runs from the buffer 200 to the reclaimer machine 300. By employing power and control from the buffer 200, the umbilicals to the reclaimer machines 300 are much shorter than would be the case if the reclaimer machine is powered and controlled by an umbilical from the surface vessel 100. Collected seafloor materials from the reclaimer machines 300 is then conveyed, in slurry form over flexible slurry hose 310, to the buffers 200.

The containers 400 travel between the buffers 200 and the surface vessel 100. When the containers 400 are located adjacent a buffer 200 they are filled up with a discrete parcel of seafloor material. Once the seafloor material has been transferred from the buffer 200, the container 400 is towed to the surface by line member 150 powered by winch 110 on the surface vessel 100. As the container travels between the buffer and the surface vessel 100 the steerable element is trimmed to take the container along a path that will avoid entanglement or collision. Once the container arrives at the surface it unloads the parcel of seafloor materials and is sent back down towards the buffer 200.

Advantageously the seafloor mining system 10 provides an efficient decoupled system of at least three stages being a concentrating stage to form windrows 22 of processed seafloor material on the seafloor, a reclaimer stage conveying material from the windrows 22 to the buffer 200, and a haulage stage which conveys the processed seafloor material from the buffers 200 to a surface vessel 100. The three stages can be performed in different areas at different times enabling a number of efficiency improvements.

For example, the concentrating system 50 can operate over large areas of the seafloor creating windrows without risk of entanglement with the haulage system 40 or getting in the way of reclaimer machines 300. For example the number of reclaimer machines 300 operating can be varied to ensure the haulage system 40 is kept well supplied in areas of different topography or with different amounts of seafloor materials. Furthermore, if there is any downtime, e.g. due to maintenance or equipment failure, in the haulage system 40 it does not prevent the concentrating system 50 from continuing the process the seafloor 20 into windrows 22 or the reclaimer machines 300 from working to fill the buffer 200 or move to new positions.

As the seafloor material has already been concentrated into windrows 22, the reclaimer machines 300 can collect the concentrated seafloor materials efficiently. As the reclaimer machines 300 are not part of the concentrating system 50 they can also be operated in areas where the concentrating system has finished operating such that they do not get in the way of the concentrating system. Furthermore, if there is any downtime, e.g. due to maintenance or equipment failure, in the concentrating system 50 it does not prevent the haulage system 40 from continuing to collect and convey previously processed seafloor materials in windrows 22 on the seafloor 20. Furthermore if the reclaimer machines 300 stop production, e.g. to move to a new position the buffer 200 and containers 400 can continue to supply seafloor material to the surface vessel 100.

The mechanical haulage system is also energy efficient, considerably more energy efficient than risers. The guided containers 400 also overcome many problems associated with mechanical haulage systems underwater such as entanglement and collision which are particularly problematic over such long depths (e.g. approximately 5,000 m).

The seafloor mining system 10 therefore provides a robust and commercially effective manner to find and obtain valuable seafloor materials.

While the figures illustrate the distance between the surface and the seabed as being relatively close, this is for convenience only and it will be appreciated that the present invention will typically be used in deep sea applications where the seabed is over 2,000 m, typically around 4,000 to 5,000 m, deep. References herein to the seafloor, seabed, subsea, or the like are for convenience only and could equally be applied to other bodies of water such as, for example, a lake with a lakebed, etc.

In this specification, adjectives such as first and second, left and right, top and bottom, and the like may be used solely to distinguish one element or action from another element or action without necessarily requiring or implying any actual such relationship or order. Where the context permits, reference to an integer or a component or step (or the like) is not to be interpreted as being limited to only one of that integer, component, or step, but rather could be one or more of that integer, component, or step etc.

The above description of various embodiments of the present invention is provided for purposes of description to one of ordinary skill in the related art. It is not intended to be exhaustive or to limit the invention to a single disclosed embodiment. As mentioned above, numerous alternatives and variations to the present invention will be apparent to those skilled in the art of the above teaching. Accordingly, while some alternative embodiments have been discussed specifically, other embodiments will be apparent or relatively easily developed by those of ordinary skill in the art. The invention is intended to embrace all alternatives, modifications, and variations of the present invention that have been discussed herein, and other embodiments that fall within the spirit and scope of the above described invention.

In this specification, the terms 'comprises', 'comprising', 'includes', 'including', or similar terms are intended to mean a non-exclusive inclusion, such that a method, system or apparatus that comprises a list of elements does not include those elements solely, but may well include other elements not listed.

The invention claimed is:

1. A seafloor mining system comprising:

at least one concentrating system that processes seafloor materials;

at least one reclaimer machine that collects the processed seafloor materials; and at least one haulage system that receives the processed seafloor materials collected by the reclaimer machine and lifts the processed seafloor materials to a surface vessel;

wherein the haulage system is a mechanical haulage system that conveys discrete parcels of seafloor material collected by the reclaimer machine to the surface vessel;

wherein the concentrating system, reclaimer machine, and haulage system are decoupled from each other;

wherein the at least one concentrating system comprises an undersea vehicle;

wherein the undersea vehicle is towed by a tow vessel located on the surface;

wherein the undersea vehicle comprises a nodule collecting apparatus, located on the seafloor, connected to a steering vehicle adapted to be towed by the tow vessel;

wherein the nodule collecting apparatus comprises a plurality of nodule collection devices;

wherein each nodule collection device is adapted to collect ore nodules from the seafloor adjacent an underside thereof and communicate those nodules to an outlet pipe; and wherein the nodule collecting apparatus comprises a combined outlet pipe adapted to receive collected ore nodules from the outlet pipe of each nodule collection device and re-deposit the collected nodules on the seafloor in the form of a windrow.

2. A seafloor mining system comprising:

at least one concentrating system that processes seafloor materials;

at least one reclaimer machine that collects the processed seafloor materials, and at least one haulage system that receives the processed seafloor materials collected by the reclaimer machine and lifts the processed seafloor materials to a surface vessel;

wherein the haulage system is a mechanical haulage system that conveys discrete parcels of seafloor material collected by the reclaimer machine to the surface vessel;

wherein the concentrating system, reclaimer machine, and haulage system are decoupled from each other;

wherein the haulage system comprises one or more containers; and wherein the containers are connected to at least one line member that extends at least partially between the seafloor and the surface.

3. The seafloor mining system of claim 2, wherein the line member is driven by a winch.

4. The seafloor mining system of claim 2, wherein at least a substantial portion of the line member is synthetic rope.

5. A seafloor mining system, comprising at least one concentrating system that processes seafloor materials;

at least one reclaimer machine that collects the processed seafloor materials; and at least one haulage system that receives the processed seafloor materials collected by the reclaimer machine and lifts the processed seafloor materials to a surface vessel;

wherein the haulage system is a mechanical haulage system that conveys discrete parcels of seafloor material collected by the reclaimer machine the surface vessel;

wherein the concentrating system reclaimer machine, and haulage system are decoupled from each other;

wherein the haulage system comprises one or more containers;

wherein each container has a steerable element that enables the container to manoeuvre as it is towed in the water; and wherein the steerable element is controlled, by actively trimming the steerable element, to guide the container along a path.

6. A method of mining the seafloor, the method comprising the steps of:

concentrating desirable seafloor materials by processing seafloor materials with a concentrating system;

collecting the processed seafloor materials with a reclaimer machine that is decoupled from the concentrating system; and conveying collected seafloor materials to a surface vessel using a mechanical haulage system, that is decoupled from the reclaimer machine, that conveys discrete parcels of seafloor material collected by the reclaimer machine to the surface vessel;

wherein the step of conveying collected seafloor materials to a surface vessel comprises transferring collected seafloor material to at least one container located at or near the seafloor; and wherein the method further comprises the step of towing the container to the surface by at least one line member.

7. The method of claim 6, wherein the step of towing the container to the surface comprises guiding the container using at least one steerable element of the container.

* * * * *